United States Patent [19]

Wimberly

[11] Patent Number: 4,999,758

[45] Date of Patent: Mar. 12, 1991

[54] LAMP HOUSING

[76] Inventor: Randal L. Wimberly, R. 1, 122 Peck Ct., P.O. Box 132, Ledbetter, Ky. 42058

[21] Appl. No.: 312,456

[22] Filed: Feb. 21, 1989

[51] Int. Cl.[5] ..... F21V 21/08; F21V 17/04

[52] U.S. Cl. ..... 362/373; 362/152; 362/277; 362/371; 362/375; 362/396; 362/455

[58] Field of Search ..... 362/152, 277, 371, 373, 362/375, 396, 455

[56] References Cited

U.S. PATENT DOCUMENTS

| | | | |
|---|---|---|---|
| 2,524,173 | 10/1950 | Peterson | 362/396 |
| 2,894,693 | 7/1959 | Howarth | 362/371 |
| 3,086,107 | 4/1963 | Grover | 362/371 |
| 3,936,023 | 2/1976 | Clifton | 362/396 |
| 4,882,667 | 11/1989 | Skegin | 362/371 |

*Primary Examiner*—Douglas Hart

*Attorney, Agent, or Firm*—Warren D. Flackbert

[57] ABSTRACT

Lamp housing which, in one form, selectively receive different sized P.A.R. lamps and, in another form, selectively receive a P.A.R. lamp or an incandescent lamp. In either instance, the P.A.R. lamp is retained in position by spaced-apart flexible latches which engage a portion of the lamp lens. Additionally, and in order to provide ventilation space between the inside of the housing and the positioned P.A.R. lamp, spacer arrangements are provided. In both housing forms, ventilation openings are provided at various locations in the housing. As an added feature, each housing form, which includes a mounting bracket, is secured in an operative position by a support clamp. The latter is unique in configuration, being defined by a first and second portion at right angles with respect to each other and an arcuate third portion. The support clamp is typically received onto a truss or the like by fastening means extending through the arcuate third portion, where the latter is threaded at preselected locations to achieve versatility in housing placement.

11 Claims, 2 Drawing Sheets

LAMP HOUSING

As is known, certain types of lighting require specialized needs, as, for example, lighting used for stage purposes, display or whatever. The aforesaid needs may be in the form of the housing or power can for the lamp; the desirability for such housing to have extended durability over those currently in use, i.e. housing made from metal; the manner of clamping the housing or power can onto a support truss which may require specialized capabilities; and, a housing selectively usable with either an incandescent type of lamp or a sealed beam or P.A.R. lamp, where such affords a degree of versatility unknown to the user heretofore.

BRIEF DESCRIPTION OF THE INVENTION

In this connection, the housing presented herein is readily adapted to receive and retain multiple size P.A.R. lamps, where provision is made for spacing the lamps from the inner surface of the housing for desired air circulation and to selectively latch and unlatch the lamps from a use condition. The housing is made from a molded high impact plastic resin and is arranged to accommodate, in the example presented herein, three sizes of P.A.R. lamp.

Additionally, the mounting bracket for the housing is readily secured to a support clamp having a unique shape whereby housing positioning may be accomplished at a myriad number of locations.

Another form of lamp housing serves for the ready retaining of both an incandescent or a sealed beam or P.A.R. lamp, as desired, again adding versatility to the user's needs.

DESCRIPTION OF THE FIGURES

In any event, a better understanding of the present invention will become more apparent from the following description, taken in conjunction with the accompanying drawing, wherein.

Figure 1:
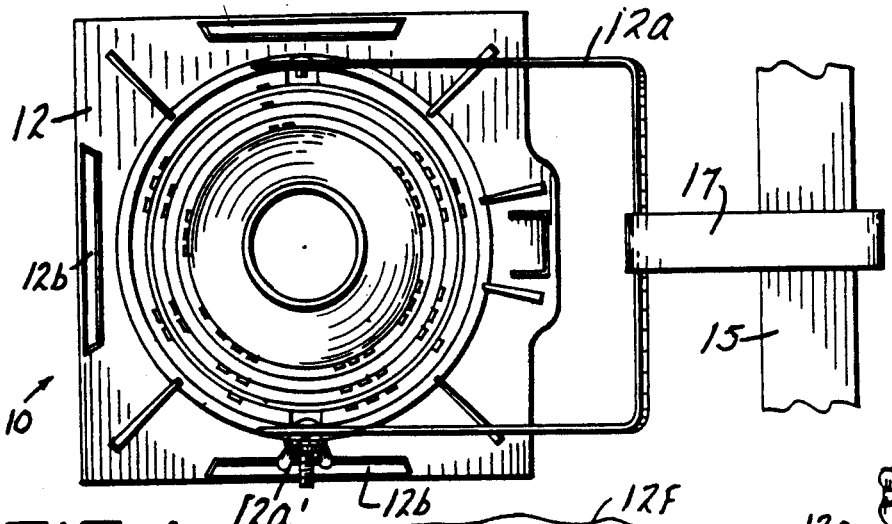
FIG. 1 is a back plan view showing a first form of lamp housing in accordance with the teachings of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 2:
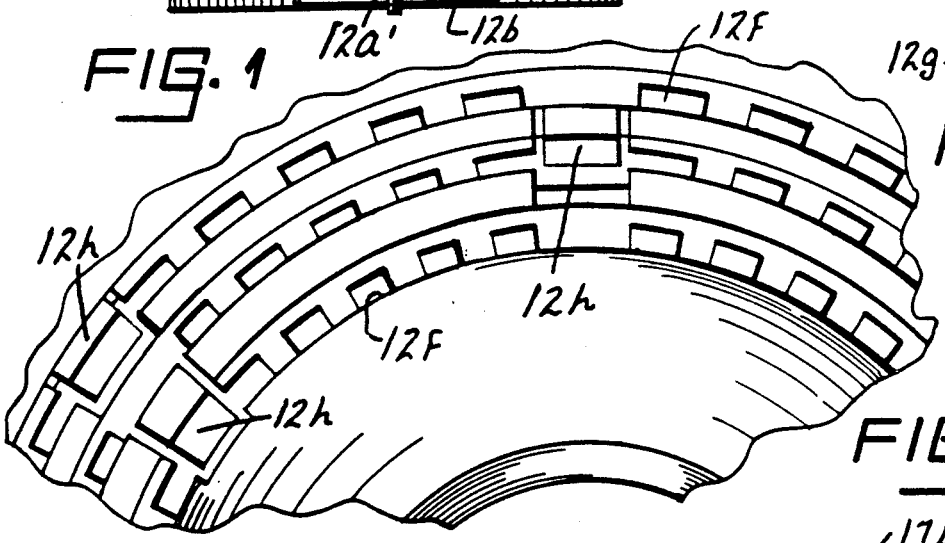
FIG. 2 is an enlarged and fragmentary back plan view detailing certain of the lamp housing of FIG. 1.
Figure 3:
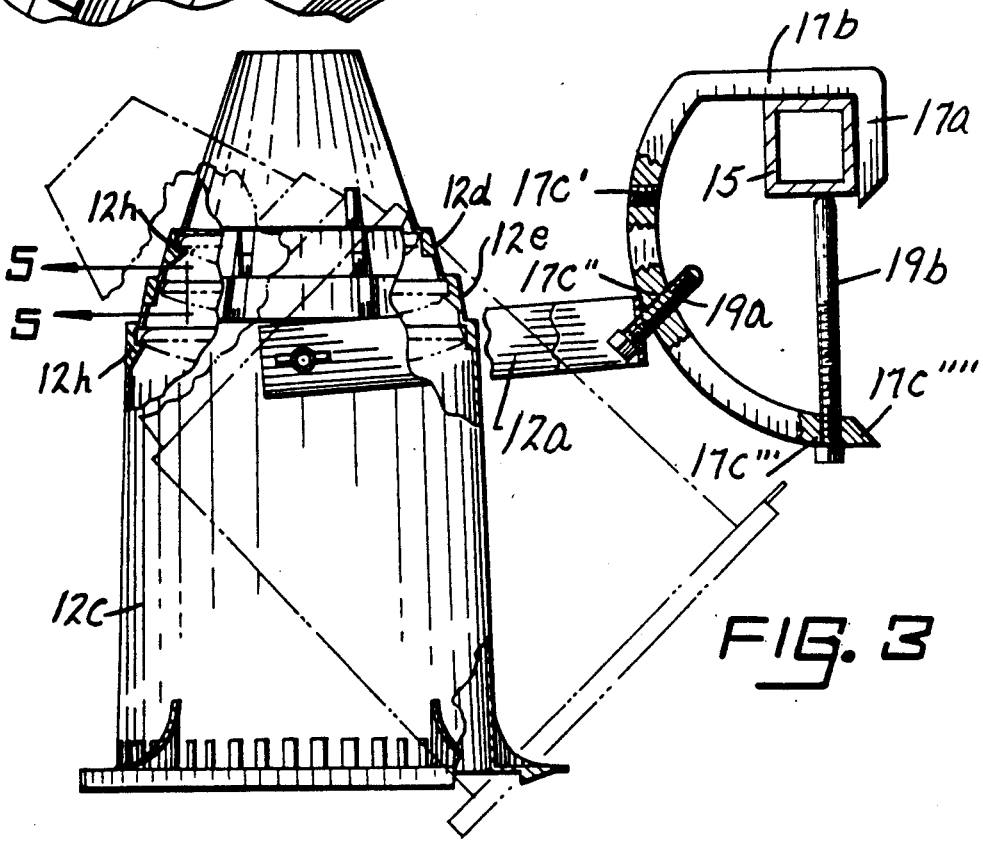
FIG. 3 is a view in side elevation of the lamp housing of FIG. 1, but also detailing a support clamp in accordance with the teachings of the present invention.
Figure 6:
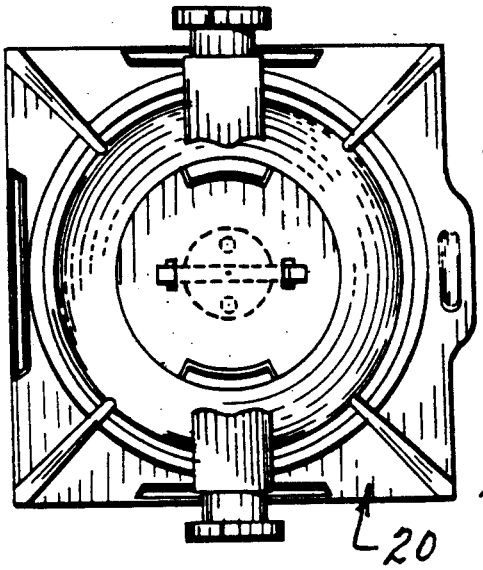
FIG. 6 is a back plan view of another form of lamp housing adaptable for usage with different types of lamp in accordance with the teachings of the present invention.
Figure 7:
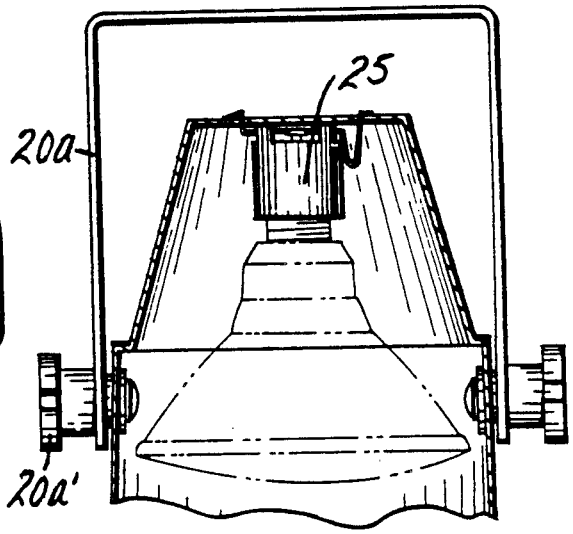
FIG. 7 is a view in vertical section, partly fragmentary, detailing the mounting of a standard threaded floodlight.
Figure 4:
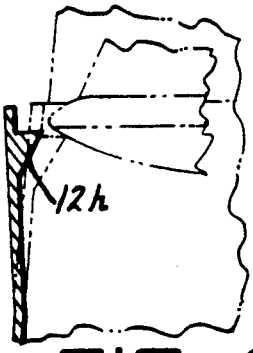
FIG. 4 is a view in side elevation, partly in phantom, further detailing the invention form carrying different sized lamps of the same type.
Figure 8:
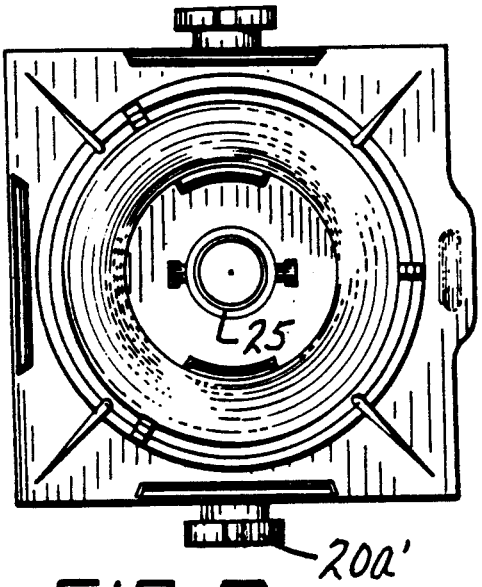
FIG. 8 is a view in front elevation of the lamp housing of FIG. 6.
Figure 9:
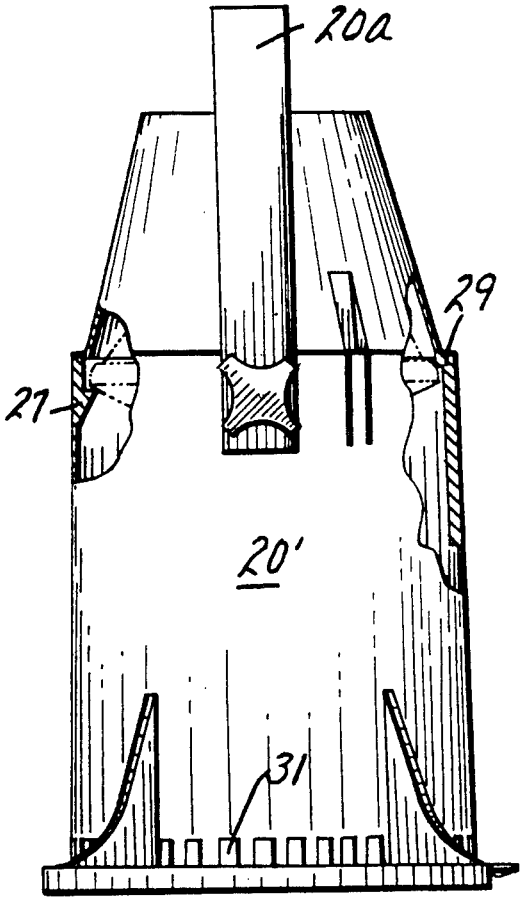
FIG. 9 is another view in side elevation showing the housing of FIG. 6 in its entirety.

Referring now to FIGS. 1 to 5, inclusive, one form of lamp housing 10 for a lamp is disclosed, including a body 12 to which a pivotal handle or mounting bracket 12*a* is secured, as by wing-nut and bolt means 12*a*′ (the latter assuring movement of the housing 10, as from the solid line to the broken line positions of FIG. 3).

Importantly, the housing body 12 and the plastic resin to assure durability and long life. In any event, the front of the housing 10 includes, at the open end of hollow portion 12*c*, flanges 12*b* for receiving and/or locating a standard gel frame (not shown).

As particularly evident in FIGS. 1 and 2, the body 12 includes reduced diameter steps 12*d* and 12*e* progressively located towards the rear of the housing 10, each serving to accommodate different sized lamps, such as the known P.A.R. lamp used in the trade. As particularly evident in FIG. 2, the rear surface of each step 12*d*, 12*e* includes an arrangement of peripheral slots 12*f* serving ventilation needs. While not detailed herein, a commercially available lampholder provides an electrical outlet for the P.A.R. lamp.

Figure 5:
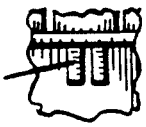
FIG. 5 is an enlarged detailed view illustrating a typical lamp positioning spacer arrangement employed herein, taken at line 5—5 on FIG. 3 and looking in the direction of the arrows.

As to FIGS. 2 and 5, spacers 12*g*, located 120° apart from each other, serve to engage the rear portion of the lens of the lamp in a spaced-apart relationship with the inner surface of the housing body 12. The preceding provides a needed path for ventilation, in addition to placement purposes.

Importantly, a flexible latch 12*h* snaps in front of the lens of the lamp at a use condition of the latter, where a total of three flexible latches 12*h* are provided at 120° spaced-apart locations. In order to release the lamp for replacement, for example, each flexible latch 12*h* is readily moved outwardly (see the solid line position in FIG. 4).

It is understood that the aforesaid spacers 12*g* and flexible latches 12*h* are provided for each of the lamp positions (shown in phantom), such being generally staggered with respect to each other (not shown in FIG. 1, but see FIG. 2). The showing of FIG. 2 is intentionally fragmentary since a complete indication of the various flexible latches 12*h* and spacers 12*g* would result in a rather unclear presentation.

In use, and referring particularly to FIG. 3, a truss 15 may be employed, together with a support clamp 17, for lamp housing 10 placement through mounting bracket 12*a*. In this connection, it will be noted that support clamp 17 includes an end portion 17*a*, another portion 17*b* at right angles therewith, and a curved portion 17*c*. The curved portion 17*c* includes fastener 19*a* receiving threads at three locations, i.e. 17*c*′, 17*c*″ and 17*c*‴, each of such serving to provide versatility in housing placement. Free end 17*c*⁗ of the curved portion 17*c* may be beveled to permit penetration into a holding surface, as, for example, if the housing 10 is disposed on a tree. A fastener 19*b* secures the support clamp 17 to the truss 15.

Referring now to FIGS. 6 to 9, inclusive, another form of housing 20 is disclosed which, in this instance, permits ready interchangeability of one lamp for another as, for example, an incandescent lamp and a P.A.R. lamp, or vice versa. When the housing 20 is used for an incandescent lamp (shown in phantom), a snap-in threaded type porcelain lampholder 25 may be employed. When a P.A.R. lamp is utilized, the lampholder is of the type which presents slots for receiving electrical contacts extending from the lamp (not detailed).

In any event, the housing 20 has the same overall configuration for either incandescent lamp or P.A.R. lamp usage, including the hollow portion 20' (for light confining purposes). In the instance of an incandescent lamp, no particular placement arrangement is necessary, i.e., and as stated, the incandescent lamp is merely threaded into porcelain lampholder 25.

In P.A.R. lamp usage, flexible latches 27, similar to those described hereabove, are employed for positive lamp placement and, as well, spacers 29 (in the form of enlargements), located 120° apart, further accommodate ventilation needs. In either instance, the mounting bracket **20*a*, conventional in form, is pivotally secured to the housing 20 at knobs 20*a'*. Moreover, and serving to further satisfy ventilation, ports 31 are peripherally arranged on housing 20**.

From the preceding, it should be evident that the lamp housing presented herein, in two embodiments, serves for effective placement of common P.A.R. lamps of different sizes, and, additionally, the interchangeable use of both a P.A.R. lamp and incandescent lamp in the same housing. Ventilation requirements are satisfied by internal spacer arrangements, while spaced-apart flexible latches retain the P.A.R. lamp in a utility position.

Moreover, the invention presents a support clamp usable with either form of housing which accommodates effective housing placement on a support boom and, therefore, extreme versatility. Further importance lies in the fact that the housing forms are preferably molded from high impact plastic resin, presenting durability and long use life.

The lamp housings, including the support clamp, described hereabove are susceptible to various changes within the spirit of the invention, as, for example, in proportioning; versatility details; type and placement of particular lampholders; the change of overall housing configuration to modify/alter/delete any usage of the hollow portion; the capabilities for added and/or fewer P.A.R. lamp placement; the precise curvature of the support clamp; and, the like. Thus, the preceding description should be considered illustrative and not as limiting the scope of the following claims:

I claim:

1. A lamp housing having a body flaring outwardly from one end to another end, spacer means disposed on the inner surface of said body proximate said another end engaging a lamp and serving ventilation purposes between said lamp and said inner surface, and flexible latching means disposed around said body at said another end in a retaining relationship with a portion of said lamp, where said flexible latching means are disposed within concentric rows accommodating different sized lamps.

2. The lamp housing of claim 1 where a plurality of ventilation openings are disposed in said body proximate said another end and a source of heat.

3. A lamp housing having a body flaring outwardly from one end to another end, spacer means disposed on the inner surface of said body proximate said another end engaging a lamp and serving ventilation purposes between said lamp and said inner surface, and flexible latching means disposed around said body at said another end in a retaining relationship with a portion of said lamp, where a mounting bracket is pivotally secured to said housing, and where a support clamp selectively positions said mounting bracket, said support clamp having a first portion, a second portion blending at right angles into said first portion, and a third portion blending into said second portion and presenting an arcuate configuration, and means extending through a location along said arcuate third portion serving a support clamp fastening relationship.

4. A lamp housing having a body flaring outwardly from one end to another end, spacer means disposed on the inner surface of said body proximate said another end engaging a lamp and serving ventilation purposes at the source of heat from said lamp and said inner surface, and flexible latching means disposed around said body at said another end in a retaining relationship with a portion of said lamp, where said body includes a hollow portion extending from said one end to said another end.

5. The lamp housing of claim 4 where a mounting bracket is pivotally secured to said housing, and where a support clamp selectively positions said mounting bracket, said support clamp having a first portion, a second portion blending at right angles into said first portion, and a third portion blending into said second portion and presenting an arcuate configuration, and means extending through a location along said arcuate third portion serving a support clamp fastening relationship.

6. The lamp housing of claim 4 where a lampholder is provided to selectively receive different types of lamps.

7. The lamp housing of claim 4 where a series of reduced diameter annular end bands including a rear surface extend rearwardly on said housing, and where said flexible latching means are selectively disposed around said bands to accommodate different sized lamps.

8. The lamp housing of claim 7 where ventilation openings are disposed along said rear surface of each of said reduced diameter annular bands.

9. The lamp housing of claim 4 where said lampholders are interchangeable.

10. The lamp housing of claim 7 where said latching means are also disposed on said hollow portion.

11. The lamp housing of claim 4 wherein said latching means are disposed on said hollow portion.

* * * * *